US008602670B2

(12) United States Patent
Shirotori et al.

(10) Patent No.: US 8,602,670 B2
(45) Date of Patent: Dec. 10, 2013

(54) PRINTER CUTTER WITH PAPER EXIT HAVING A NOTCH

(75) Inventors: Motoyoshi Shirotori, Shiojiri (JP); Shinsuke Tomomatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

(21) Appl. No.: 12/715,358

(22) Filed: Mar. 1, 2010

(65) Prior Publication Data

US 2010/0221056 A1 Sep. 2, 2010

(30) Foreign Application Priority Data

Mar. 2, 2009 (JP) ..... 2009-047662

(51) Int. Cl.
*B41J 11/70* (2006.01)
*B26D 1/08* (2006.01)

(52) U.S. Cl.
CPC ..... *B41J 11/703* (2013.01); *B26D 1/085* (2013.01)
USPC ..... 400/621; 83/694

(58) Field of Classification Search
USPC ..... 400/621; 83/607–609
See application file for complete search history.

(56) References Cited

U.S. PATENT DOCUMENTS

| | | | | |
|---|---|---|---|---|
| 6,405,625 | B1 | 6/2002 | Nomura et al. | |
| 7,819,599 | B2 | 10/2010 | Kobayashi et al. | |
| 7,878,724 | B2 * | 2/2011 | Yamagata | 400/664 |
| 2008/0199239 | A1 * | 8/2008 | Kohira | 400/621 |
| 2010/0192746 | A1 * | 8/2010 | Flood et al. | 83/697 |

FOREIGN PATENT DOCUMENTS

| | | | | | |
|---|---|---|---|---|---|
| CN | 1263500 | A | | 8/2000 | |
| CN | 101143526 | | | 3/2008 | |
| JP | 05116400 | A | * | 5/1993 | B41J 11/66 |
| JP | 07308891 | A | * | 11/1995 | B26D 1/38 |
| JP | 09-019890 | A | | 1/1997 | |
| JP | 09277189 | A | * | 10/1997 | B26D 1/38 |
| JP | 09-314938 | A | | 12/1997 | |
| JP | 2001-294360 | A | | 10/2001 | |
| JP | 2004122430 | A | * | 4/2004 | |
| JP | 2005219342 | A | * | 8/2005 | B41J 15/04 |
| JP | 2007076134 | A | * | 3/2007 | |
| JP | 2007175909 | A | * | 7/2007 | B41J 15/04 |

* cited by examiner

*Primary Examiner* — Daniel J Colilla
(74) *Attorney, Agent, or Firm* — Kilpatrick Townsend & Stockton LLP

(57) ABSTRACT

In a scissor type automatic cutter 20, as the movable knife 22 pivots, adhesive between the web liner 11*a* and the continuous label 11*b* medium is squeezed out from the label paper 11 at the distal end side of the movable knife 22 and sticks to the fixed knife 21 or the movable knife 22. Because a notched opening 44 is formed in the upstream edge 50*a* in the paper discharge direction at the other edge part in the paper width direction of the substantially horizontal stage surface 40, if adhesive sticking to the fixed knife 21 or movable knife 22 moves to the stage surface 40 side, the adhesive can be removed from the notched opening 44 and does not accumulate on the stage surface 40. As a result, cutting problems caused by penetration of accumulated adhesive between the fixed knife 21 and movable knife 22 can be prevented.

15 Claims, 6 Drawing Sheets

PRINTER CUTTER WITH PAPER EXIT HAVING A NOTCH

This application claims priority under 35 U.S.C. §119 to Japanese Patent Application No. 2009-047662 filed on Mar. 2, 2009, the entire disclosure of which are expressly incorporated by reference herein.

BACKGROUND

1. Technical Field

The present invention relates to a scissor-type cutter having a movable knife that pivots to and away from a fixed knife, and to a printer having an automatic cutter and a paper exit of which the bottom edge is a substantially horizontal surface and from which the cut-off ends of recording medium (the cut paper) are discharged. More specifically, the invention relates to an automatic cutter whereby defective cuts resulting from adhesive squeezed out from the edges of label paper when the paper is cut do not occur, and to a printer having the automatic cutter.

2. Related Art

One type of label paper used for printing has an uncut label medium of the same constant width as the continuous liner backing to the surface of which the label medium is affixed by adhesive like a continuous tape. Such label paper is referred to as full-surface uncut label paper or continuous label paper, and is used to cut and print labels of different sizes. Printers having an automatic paper cutter for cutting the printed portion of the label paper may be used to produce labels using uncut label paper. The automatic cutter is disposed to the transportation path from the print head or printing position to the paper exit at the downstream end part in the transportation direction, and the printed label that is the cut-off portion of the label paper is discharged from the paper exit.

A scissor type automatic paper cutter that can be disposed in a printer is taught in Japanese Unexamined Patent Appl. Pub. JP-A-H09-19890. In the automatic cutter taught in JP-A-H09-19890 the fixed knife is disposed with the cutting edge facing up, and the movable knife pivots on a support pin at one end in the cutting direction of the movable knife between a standby position where a specific gap is formed between the cutting edge of the movable knife and the cutting edge of the fixed knife, and a cutting-completed position where the cutting edge of the movable knife and the cutting edge of the fixed knife overlap throughout the entire range of the cutting direction. A spring member that pushes the movable knife toward the fixed knife is attached to the support pin, and the compression force between the cutting edge of the movable knife and the cutting edge of the fixed knife is maintained to greater than or equal to the compression force required to cut the recording paper by means of this spring member. The label paper is inserted on the transportation path from the fixed knife side and the cut-off portion is discharged from the movable knife side.

The paper exit disposed to the automatic cutter or a printer with an automatic cutter must have a narrow opening so that foreign matter is not inserted from the outside, and is generally long and narrow in the cutting direction (the paper width direction). More specifically, the bottom edge of the paper exit is commonly positioned slightly below the cutting edge of the fixed knife and the top edge of the paper exit is positioned slightly above the cutting edge of the fixed knife so that the vertical size of the opening is reduced. When the movable knife moves toward the cutting-completed position with this configuration, however, the upstream side end part in the paper discharge direction of the cut-off portion is pushed below the bottom edge of the paper exit by the downward moving movable knife. The cut-off portion also becomes curled. As a result, when the movable knife returns to the standby position, the cut-off portion may spring up as a result of the resilience of the paper when the curled portion returns.

To prevent the cut-off portion from popping out from the paper exit, the bottom edge of the paper exit may have a substantially level stage that extends for a specific width in the cutting direction along the edge of the fixed knife slightly below the cutting edge of the movable knife at the cutting-completed position. Because the stage that determines the bottom edge of the paper exit in this configuration is positioned below the cutting edge of the movable knife at the cutting-completed position, the movable knife does not push the upstream end part of the cut-off portion down when cutting, the upstream end part of the cut-off portion is above the bottom edge of the paper exit and is not caused to curl. In addition, because cut-off portion is placed on the stage when cutting is completed, the cut-off portion rests stably. Rendering the bottom edge of the paper exit from which the cut-off portion is discharged by means of a substantially level stage is therefore beneficial.

However, when the bottom edge of the paper exit is determined by a stage surface that is positioned below the cutting edge of the movable knife when the movable knife has moved to the cutting-completed position of a scissor type automatic cutter, adhesive is squeezed from between the liner and the label and builds up on the stage surface when uncut label paper is cut because the uncut label paper is cut from one edge by the scissor action of the movable knife and the fixed knife. More specifically, because the compression force between the cutting edge of the fixed knife and the cutting edge of the movable knife is applied at the side of the support pin that is the pivot point of the movable knife, the compression force weakens to the other side in the cutting direction away from the support pin. As a result, when the label paper is cut, the adhesive between the liner and the label is pushed from the support pin side of the movable knife to the distal end while being squeezed between the fixed knife and the movable knife, and the adhesive sticks to the edge of the fixed knife and the cutting edge of the movable knife.

More particularly, because the adhesive is pushed out to the distal end side of the movable knife at the cutting end side, there is a tendency for a large amount of adhesive to stick at the distal end side of the movable knife. The adhesive that sticks to the cutting edge of the movable knife then moves gradually down from the movable knife due to gravity and sticks to the stage surface. The adhesive sticking to the edge of the fixed knife is also scraped down with the movement of the movable knife and builds up on the stage surface. When the adhesive accumulates on the stage, the accumulated adhesive gets between the cutting edge of the movable knife and the cutting edge of the fixed knife, interferes with cutting, and thus results in deficient cuts.

SUMMARY

A cutter and a printer having a cutter according to at least of one embodiment of the present invention are free of defective cuts caused by adhesive that is squeezed from an edge of the label paper even when the bottom edge of the paper exit from which the cut-off label paper is discharged in a scissor type cutter is defined by a stage.

A first aspect of the present invention is a cutter including a fixed knife, a movable knife that moves relative to the fixed knife and cuts paper, and a paper exit having opposing surfaces from which the paper is discharged. The movable knife is rendered to pivot at one end part thereof, and a notch is formed at a position on the cutting edge side of the movable knife in one of the opposing surfaces of the paper exit.

This aspect of the invention has a notch formed in the surface (stage surface) that defines one surface of the paper exit at the upstream end part in the paper discharge direction of the cutting edge side part of the cutting direction of the movable knife. As a result, when the movable knife cuts while squeezing the label paper from the pivot axis end to the cutting edge and adhesive is pushed from the edge of the label paper and sticks and accumulates on the stage surface in the cutting edge direction of the movable knife, the adhesive can be removed into the notch. More specifically, when a scissor type cutter has a stage surface disposed to the discharge side from the position of the cutter, and continuous uncut label paper is cut repeatedly, adhesive is squeezed from the edge of the label paper at the distal end side of the movable knife in the cutting direction where the contact force between the cutting edge of the movable knife and the cutting edge of the fixed knife weakens. This adhesive sticks to the face of the fixed knife and the cutting edge of the movable knife, gradually moves down and tends to stick to the stage surface where it builds up, but the adhesive can be removed and received into the notch. As a result, accumulation of adhesive on the stage surface can be reduced or avoided, and cutting problems caused by adhesive buildup can be avoided.

In order to remove adhesive that builds up on the stage surface from the notch, the notch in another aspect of the invention may be a narrow notched opening that is long in the cutting direction of the movable knife or the fixed knife. Further alternatively, the notch may be a narrow notched step that is long in said cutting direction in plan view.

Further preferably, the downstream edge in the paper discharge direction of the notch is positioned on the downstream side in the paper discharge direction from the movable knife. With this configuration, if adhesive sticking to the downstream face of the movable knife in the paper discharge direction is transferred to the stage surface, the adhesive can be removed and escaped into the notch.

Yet further preferably, one of the surfaces defines a bottom side of the paper exit, a sloped guide surface is formed extending downward in the downstream direction of the paper discharge direction at the downstream edge of said surface in the paper discharge direction, and cutter also includes a first side wall that defines one side of the cutting direction of the paper that passes over said surface and the sloped guide surface and can move in the cutting direction relative to said surface and the sloped guide surface, and a second side wall that defines the other side of the cutting direction of the paper and can move in the cutting direction relative to a portion of said surface further downstream than the downstream edge in the paper discharge direction of the notch and the sloped guide surface.

With this aspect of the invention, the notch rendered in the surface will not be blocked even if the second side wall that defines the other side in the cutting direction of the position where the paper passes is moved to accommodate different paper widths. As a result, adhesive that drops from the face of the fixed knife or the cutting edge of the movable knife can be removed regardless of where the second side wall is positioned in the cutting direction.

Another aspect of the invention is a printer having a cover that opens and closes to the case, and the foregoing cutter disposed with the movable knife positioned on the case side and the fixed knife positioned on the cover side. If, for example, the fixed knife is disposed on the side of the cover, which opens and closes a roll paper compartment for storing roll paper, when the cover is opened to load roll paper, the roll paper is loaded in the roll paper compartment, and the cover is then closed, the paper can be easily set between the fixed knife and the movable knife.

Effect of at Least of One Embodiment of the Invention

At least of one embodiment of the invention has a notch formed in a surface of the paper exit at the upstream end part of the cutting edge side part in the cutting direction of the movable knife. As a result, when adhesive is pushed out from the edge of the label paper while cutting and sticks and accumulates on the stage surface, the adhesive can be removed into the notch. More specifically, when a scissor type cutter has a surface disposed at the paper exit, adhesive is squeezed from the edge of the label paper at the distal end side of the movable knife in the cutting direction where the contact force between the cutting edge of the movable knife and the cutting edge of the fixed knife weakens when the label paper is cut. This adhesive sticks to the face of the fixed knife and the cutting edge of the movable knife, gradually moves to and sticks on the surface where it builds up and can interfere with cutting, but the adhesive can be escaped into the notch and removed from the surface. As a result, accumulation of adhesive on the surface can be reduced or avoided, and cutting problems caused by adhesive squeezed out from label paper, for example, can be avoided.

Other objects and attainments together with a fuller understanding of the invention will become apparent and appreciated by referring to the following description and claims taken in conjunction with the accompanying drawings.

DESCRIPTION OF EMBODIMENTS

A printer with an automatic cutter according to a preferred embodiment of the present invention is described below with reference to the accompanying figures.

General Configuration

Figure 1A:
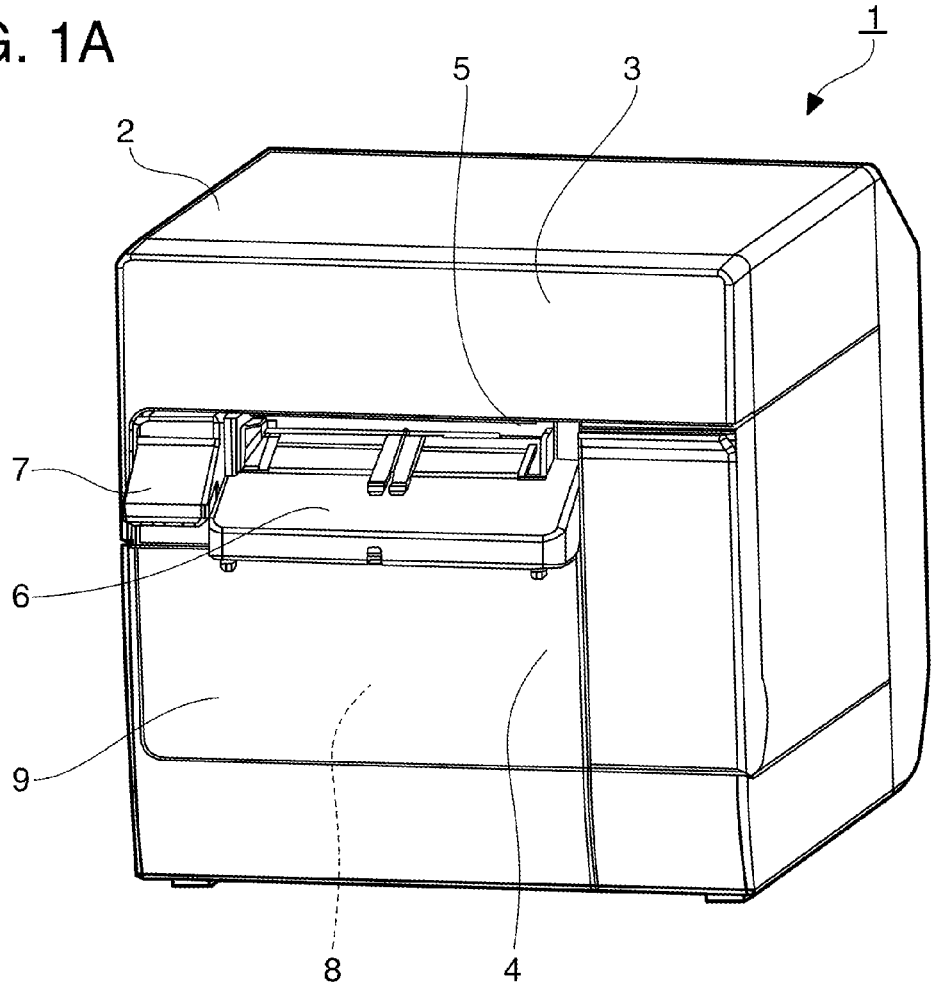
FIG. 1A is an oblique view of a printer with an automatic cutter.
Figure 1B:
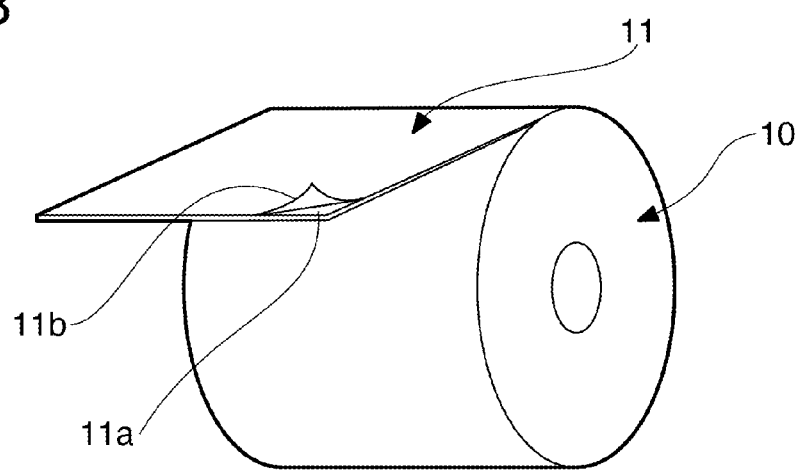
FIG. 1B is an oblique view of roll paper.
Figure 2:
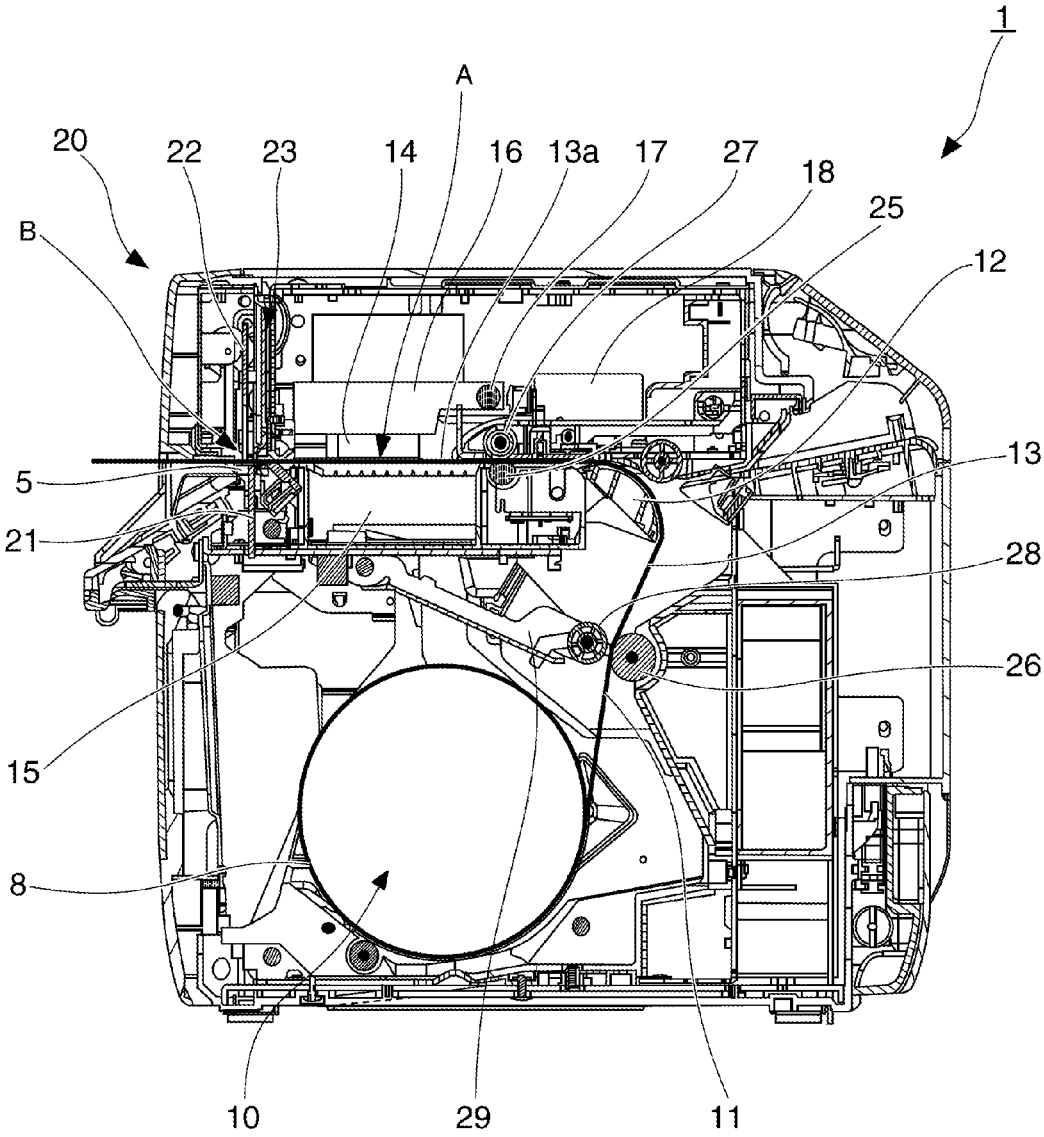
FIG. 2 is a section view showing the configuration of the inside of a printer with an automatic cutter.

FIG. 1A is an oblique view of a printer with an automatic cutter according to this embodiment of the invention, and FIG. 1B is an oblique view of roll paper that is used in the printer with the automatic cutter. FIG. 2 is a section view showing the internal configuration of the printer with an automatic cutter.

As shown in FIG. 1A, the printer with automatic cutter 1 has a printer housing 2 having a generally rectangular box-like shape. The front of the printer housing 2 is covered by a top case 3 and a bottom case 4, and has a rectangular paper exit 5 of a specific width formed therebetween. A paper exit guide 6 protrudes to the front below the paper exit 5, and a opening/closing lever 7 is disposed beside the paper exit guide 6. An opening to a roll paper compartment 8 formed inside the printer housing 2 is formed in the bottom case 4 below the paper exit guide 6 and opening/closing lever 7, and this opening is closed by an access cover 9. When the opening/closing lever 7 is operated and the access cover 9 opened, roll paper 10 can be loaded into the roll paper compartment 8.

Various types of paper can be used as the roll paper 10, including roll paper having a continuous web of recording paper of a specific width wound into a roll, rolls of label paper having labels of a predetermined shape (die-cut labels) affixed at a predetermined interval on the surface of a continuous web liner of a predetermined width, and rolls of label paper having a continuous web of label stock of a predetermined width affixed to the surface of a continuous web liner of a predetermined width (uncut continuous label paper).

As shown in FIG. 1B, this embodiment of the invention uses label paper 11 having an uncut continuous label 11*b* medium affixed to the web liner 11*a* wound into a roll by way of example.

As shown in FIG. 2, the roll paper compartment 8 is formed in the center between the side walls of the printer housing 2 inside the printer with automatic cutter 1. The roll paper 10 is stored in the roll paper compartment 8 with the roll paper 10 resting on its side horizontally widthwise to the printer.

The label paper 11 web delivered from the roll paper 10 loaded in the roll paper compartment 8 is pulled diagonally upward, then curves around a curved tension guide 12, and is then conveyed through a paper transportation path 13 that extends horizontally to the paper exit 5. The tension guide 12 is urged upward by the force of a spring, and a specific tension is applied to the label paper 11 passing around the tension guide 12.

The horizontal portion of the paper transportation path 13 is directly above the roll paper compartment 8. An inkjet print head 14 and vacuum platen 15 are disposed in mutual opposition with a specific gap therebetween in this horizontal transportation path portion 13*a*, and the printing position A of the inkjet print head 14 is determined by the vacuum platen 15. The inkjet print head 14 is carried on a carriage 16, and the carriage 16 is moved bidirectionally widthwise to the printer along a carriage guide shaft 17 by means of a carriage motor 18.

A cutting position B is disposed on the downstream side in the paper transportation direction from the printing position A. The automatic cutter 20 is disposed to the cutting position B, and the label paper 11 printed at the printing position A is cut widthwise to the printer (across the paper width) at this cutting position B.

The automatic cutter 20 includes a fixed knife 21 disposed with the cutting edge facing up, a movable knife 22 disposed with the cutting edge facing down, a movable knife drive mechanism 23, and the paper exit 5. The paper exit 5 of the automatic cutter 20 is also the paper exit 5 of the printer with automatic cutter 1. The fixed knife 21 and the movable knife 22 are disposed so that the cutting direction is aligned with the printer width (the paper width). The fixed knife 21 is disposed on the upstream side in the paper transportation direction (paper discharge direction) of the paper transportation path 13, the movable knife 22 is disposed on the downstream side in the paper transportation direction, and the paper exit 5 is on the downstream side of the movable knife 22.

The transportation mechanism for conveying the label paper 11 along the paper transportation path 13 includes a paper feed roller 25, a delivery roller 26, and a paper feed motor and delivery motor for rotationally driving these rollers. The paper feed roller 25 is located on the paper transportation path 13 upstream side in the paper transportation direction from the printing position A, and is rotationally driven by the paper feed motor not shown. A first pressure roller 27 is pressed against and rotates in conjunction with the paper feed roller 25.

The delivery roller 26 is for supplying label paper 11 from the roll paper compartment 8, and is located on the paper transportation path 13 on the upstream side in the paper transportation direction from the tension guide 12. The delivery roller 26 is rotationally driven by a delivery motor not shown, and a second pressure roller 28 is pressed against and rotates in conjunction with the delivery roller 26. The second pressure roller 28 is attached to a distal end part of a pressure lever 29 that extends toward the back from a position below the vacuum platen 15. This pressure lever 29 is pushed down by the force of a spring, and is urged to the delivery roller 26.

The label paper 11 pulled from the roll paper 10 in the roll paper compartment 8 is conveyed by the transportation mechanism through the paper transportation path 13. The inkjet print head 14 prints on the label side of the paper at the printing position A. The automatic cutter 20 cuts the label paper 11 at the cutting position B so that the cut-off portion 11*c* contains the printed area. A label of a desired length is thus issued from the paper exit.

Automatic Cutter

Figure 3:
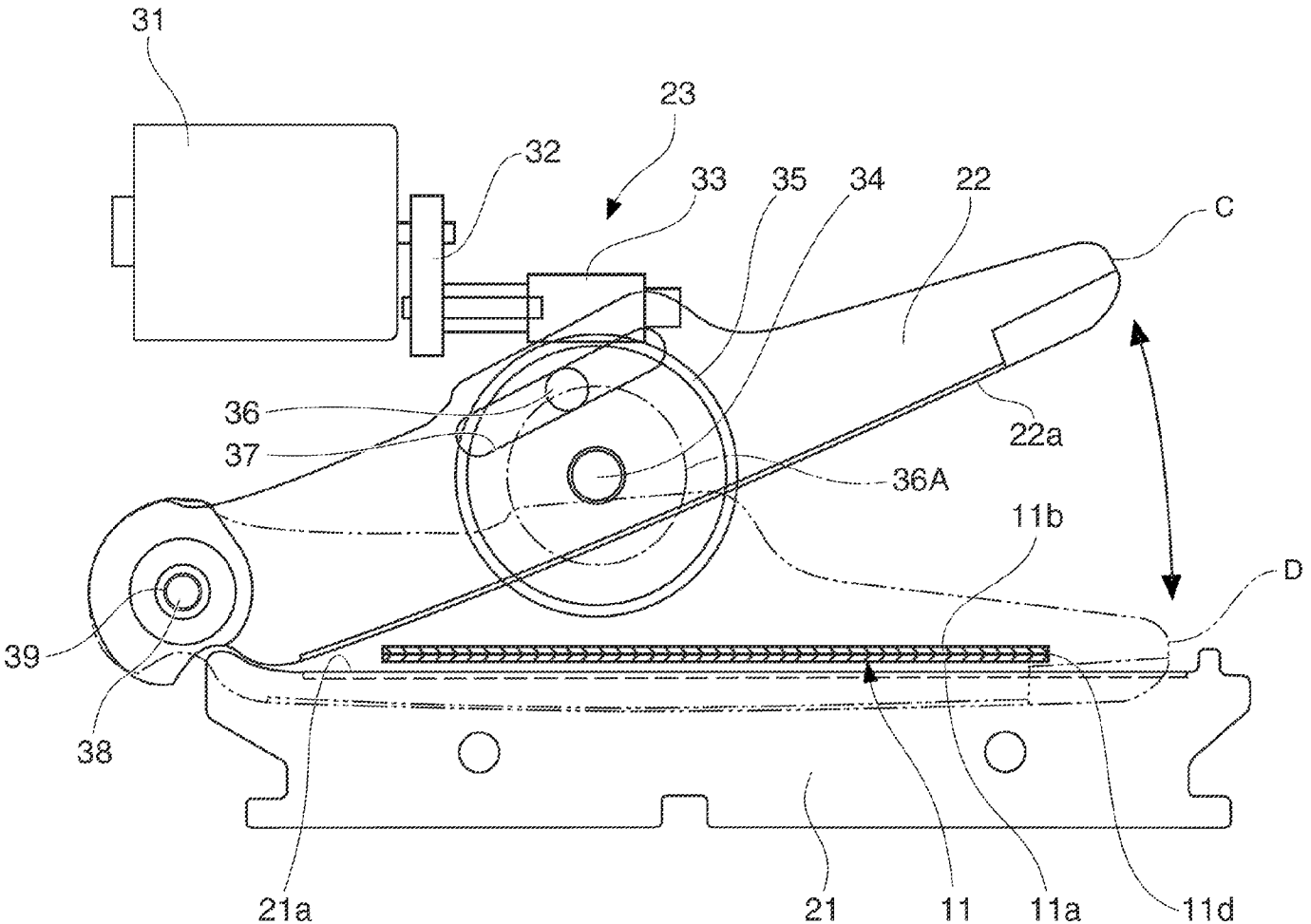
FIG. 3 is a schematic diagram of the automatic cutter.

FIG. 3 is a schematic view of the fixed knife 21, movable knife 22, and movable knife drive mechanism 23 of the automatic cutter 20.

The automatic cutter 20 is a scissor cutter. Torque from a cutter motor 31 causes the movable knife 22 to pivot up and down at one end thereof widthwise to the printer between a standby position C (denoted by the solid line in FIG. 2) where a specific gap is formed between the cutting edge 22*a* of the movable knife 22 and the cutting edge 21*a* of the fixed knife 21, and a cutting-completed position D (denoted by the imaginary line in FIG. 3) where the cutting edge 22*a* of the movable knife 22 and the cutting edge 21*a* of the fixed knife 21 overlap throughout the entire range thereof widthwise to the printer (the cutting direction).

The movable knife drive mechanism 23 has a worm gear 33 that is rotationally driven by the cutter motor 31 through a power transfer mechanism 32. The worm gear 33 meshes with a worm wheel 35 that is affixed to rotate freely on a support shaft 34. The rotational motion of the worm wheel 35 is converted by a crank mechanism to the bidirectional vertical motion of the movable knife 22.

The crank mechanism includes a crank pin 36 attached perpendicularly to the round end face of the worm wheel 35 at a position offset from the axis of rotation, and a straight slide channel 37 of a specific length formed in the movable knife 22. The crank pin 36 is inserted so that it can slide in the slide channel 37, and rotates along a circular path of rotation 36A denoted by the dot-dash line in FIG. 3 in conjunction with rotation of the worm wheel 35.

The length of the slide channel 37 is set so that it can move tracking the movement of the crank pin 36 vertically and widthwise to the printer, and the movable knife 22 can pivot vertically on the support shaft 38 on which one end thereof is supported.

A coil spring 39 that pushes the movable knife 22 to the fixed knife 21 is disposed to the support shaft 38, and the compression force between the cutting edge 22*a* of the movable knife 22 and cutting edge 21*a* of the fixed knife 21 is held to the compression force required to cut the label paper 11 by means of the urging force of this coil spring 39.

When the worm wheel 35 turns one revolution, the movable knife 22 travels once back and forth between the standby position C and the cutting-completed position D, and can cut the label paper 11 disposed between the movable knife 22 and the fixed knife 21 across the width of the paper.

Note that the fixed knife 21 is attached to the access cover 9 of the bottom case 4, and moves in front of the printer housing 2 together with the access cover 9 when the access cover 9 opens. The movable knife 22 is disposed on the top case 3 side. Therefore, when the access cover 9 is opened, the roll paper 10 is loaded in the roll paper compartment 8, and the access cover 9 is closed, the label paper 11 pulled off from the roll paper 10 can be easily set between the fixed knife 21 and the movable knife 22.

Figure 4A:
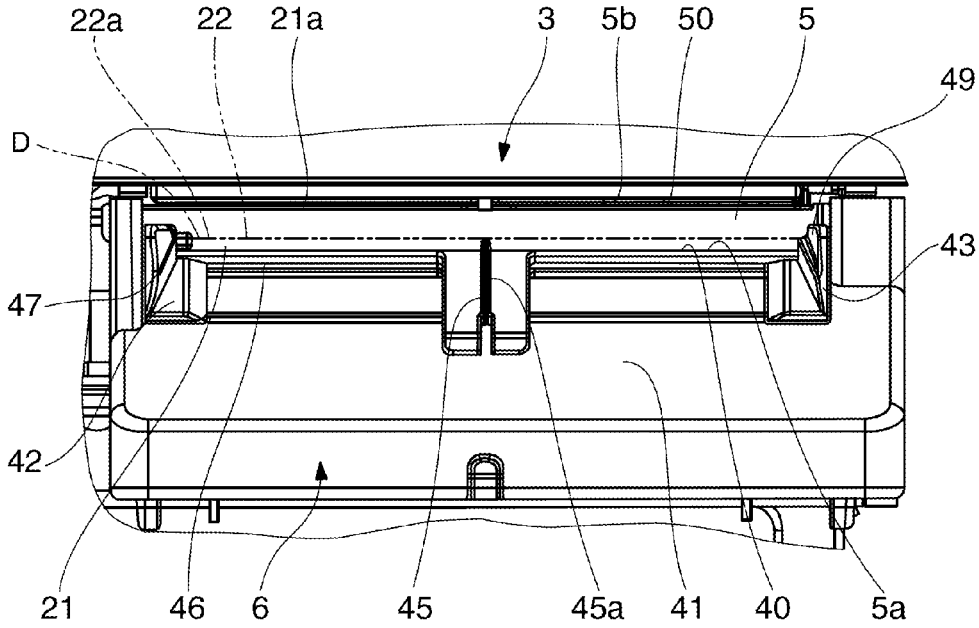
FIG. 4A is a front view showing the part around the paper exit.
Figure 4B:
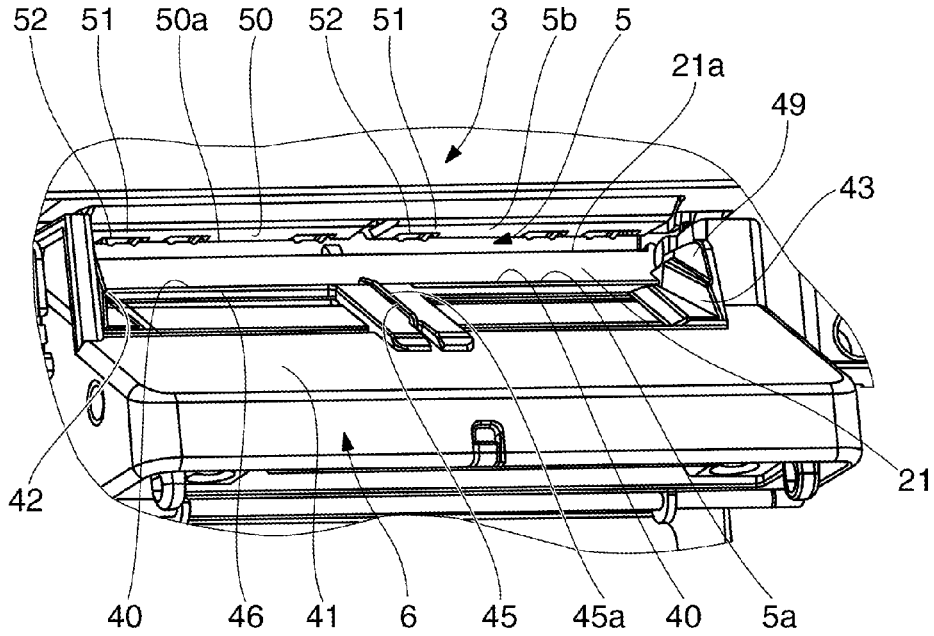
FIG. 4B is an oblique view showing the part around the paper exit.
Figure 5A:
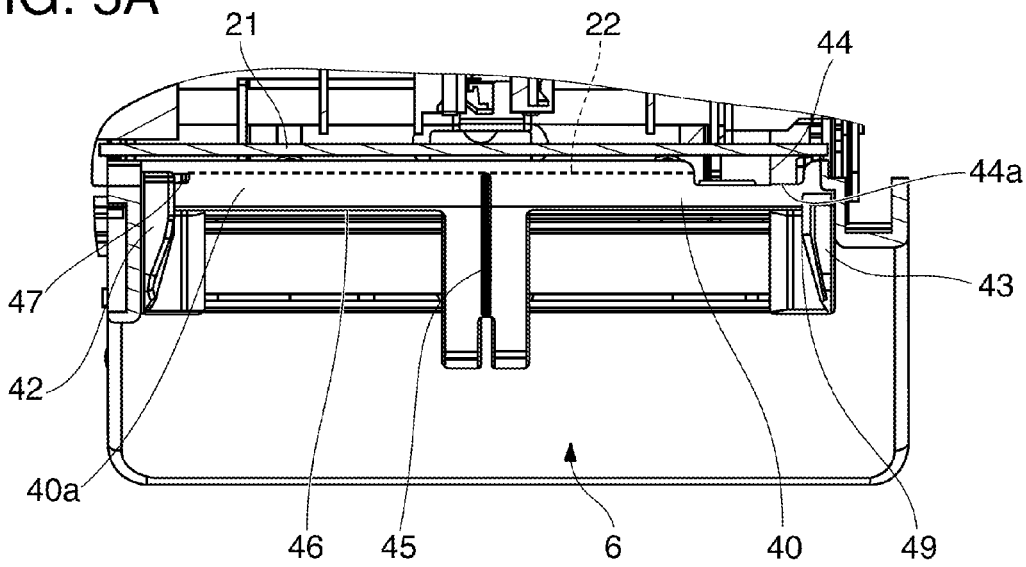
FIG. 5A is a plan view of the part around the paper exit guide.
Figure 5B:
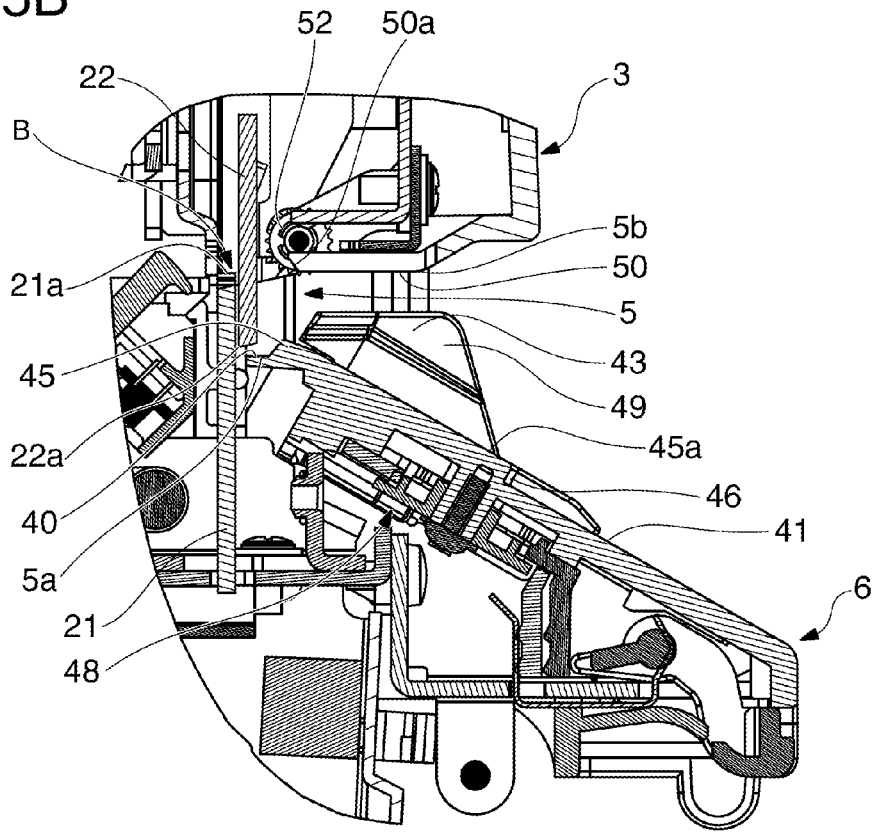
FIG. 5B is a vertical section view of the part around the paper exit guide.

The paper exit 5 is described next with reference to FIG. 4 and FIG. 5. FIG. 4A is a front view of the part around the paper exit 5, and FIG. 4B is an oblique view showing the part around the paper exit 5 as seen from diagonally below. FIG. 5A is a plan view of the part around the paper exit guide 6 with the top case 3 and movable knife 22 removed, and FIG. 5B is a vertical section view of the part around the paper exit 5 through the paper transportation direction of the paper transportation path 13 when the fixed knife 21 is in the cutting-completed position D.

The paper exit 5 is a narrow, rectangular opening that is long widthwise to the printer. The bottom edge 5*a* of the paper exit 5 is rendered by the paper exit guide 6, and the top edge 5*b* of the paper exit 5 is rendered by the top case 3.

The paper exit guide 6 has a stage surface 40 (surface) of a specific width extending substantially horizontally widthwise to the printer along the edge of the fixed knife 21 at a position slightly lower than the cutting edge 22*a* of the movable knife 22 in the cutting-completed position D, and a sloped guide surface 41 that extends downward toward the downstream side of the paper transportation direction from downstream end edge of the stage surface 40. The paper exit guide 6 also has a first side wall 42 that defines one side of the paper exit guide 6 widthwise to the printer where the label paper 11 passes over the stage surface 40 and the sloped guide surface 41, and a second side wall 43 that defines the other side. The stage surface 40 defines the bottom edge 5*a* of the paper exit 5.

As shown in FIG. 5A, a rectangular notched opening 44 that is narrow and long widthwise to the printer is formed at the upstream end edge on the other end part of the stage surface 40 widthwise to the printer at a position on the cutting edge side of the movable knife 22. The notched opening 44 is formed to include a stage surface part 40*a* on the downstream side in the paper transportation direction from the movable knife 22 denoted by the dotted line. More specifically, the downstream edge 44*a* of the notched opening 44 is located downstream in the paper transportation direction from the movable knife 22.

A long, narrow protrusion 45 extending in the paper transportation direction from the stage surface part 40*a* to the sloped guide surface 41 is formed in the middle of the stage surface 40 widthwise to the printer. The top surface 45*a* of the protrusion 45 slopes downward to the downstream side of the paper transportation direction.

The first side wall 42 is configured so that it can move widthwise to the printer sliding on the stage surface part 40*a*, the sloped guide surface 41, and the stepped surface 46 between the stage surface part 40*a* and the sloped guide surface 41. A protrusion 47 that projects to the second side wall 43 side is formed at an upstream end part of the first side wall 42. The top end of this protrusion 47 is at a height that is lower than the cutting edge 21*a* of the fixed knife 21.

The second side wall 43 is configured so that it can slide widthwise to the printer sliding on the surface part of the stage surface part 40*a* on the downstream side in the paper transportation direction from the downstream edge 44*a* of the notched opening 44, the sloped guide surface 41, and the stepped surface 46.

As shown in FIG. 5B, a linkage mechanism 48 is disposed on the back side of the sloped guide surface 41. This linkage mechanism 48 causes the second side wall 43 to move the same distance in the opposite direction as the first side wall 42 when the first side wall 42 is moved widthwise to the printer, the second side wall 43 thus moves in conjunction with movement of the first side wall 42, and enables adapting to label paper 11 of different paper widths. The top part on the inside face of the second side wall 43 facing the first side wall 42 is cut away, rendering a notched step 49.

A paper exit ceiling 50 extending substantially horizontally opposite the stage surface 40 at substantially the same height as the cutting edge 21*a* of the fixed knife 21 is formed at the bottom edge part of the top case 3 on the downstream side in the paper transportation direction of the movable knife 22. This paper exit ceiling 50 defines the top edge 5*b* of the paper exit 5.

The upstream edge 50*a* of the paper exit ceiling 50 slopes upward. A plurality of rectangular notches 51 is formed in the upstream edge 50*a* of the paper exit ceiling 50, and the outside surface part of a knobby roller 52 is exposed from each of the notches 51. These rollers 52 are disposed with the axis of rotation extending widthwise to the printer above the stage surface 40. The outside surfaces on the bottom side of the knobby rollers 52 are opposite the stage surface 40, and the outside surfaces of the knobby rollers 52 on the upstream side are opposite the movable knife 22.

Cutting and Discharging the Label Paper

Figure 6A:
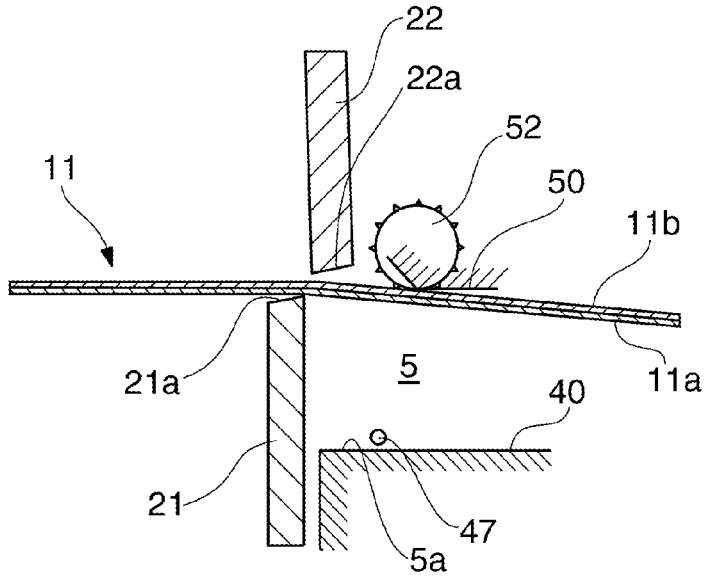
FIG. 6A and FIG. 6B describe cutting paper in a label printer.
Figure 6B:
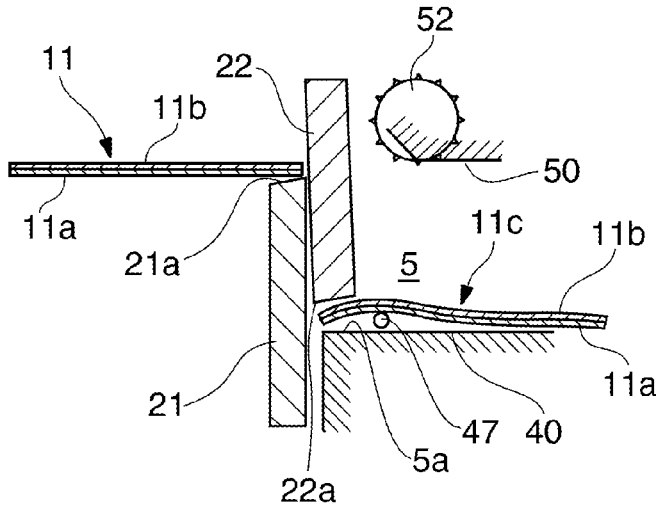
Figure 6C:
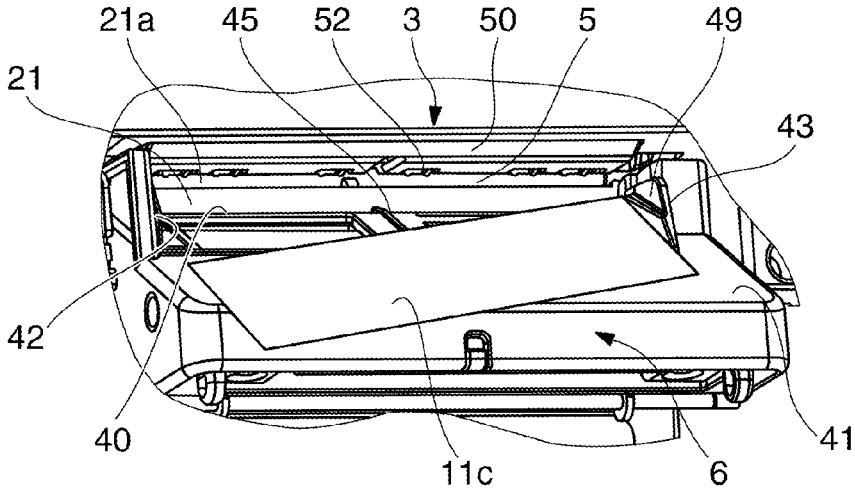
FIG. 6C describes the discharge of paper in a label printer.

Cutting and discharging the label paper 11 from the paper exit 5 is described next with reference to FIG. 6. FIG. 6A schematically shows the label paper 11 passing the cutting position B, FIG. 6B shows immediately after the label paper 11 is cut, and FIG. 6C shows the cut-off portion discharged from the paper exit.

The label paper 11 printed at the printing position A is conveyed by the transportation mechanism to the position where the printed portion on the label side is on the downstream side in the paper transportation direction from the cutting position B. When the label paper 11 passes the cutting position B, the label paper 11 is guided to the downstream side in the paper transportation direction of the paper exit 5 while the knobby rollers 52 rotate with the label surface in contact with the tips of the knobs on the outside surfaces of the knobby rollers 52 as shown in FIG. 6A.

As a result, the printed portion will not rub against the paper exit ceiling 50 and be damaged when the ink in the printed portion formed on the label surface of the continuous label 11*b* is not completely dry.

When the transportation operation stops, the movable knife 22 moves from the standby position C to the cutting-completed position D. As a result, the point of intersection with the cutting edge 21*a* of the fixed knife 21 moves from one end to the other widthwise to the printer, and the part of the label paper 11 positioned therebetween is cut.

When the cutting edge 22*a* of the movable knife 22 moves to below the bottom edge 5*a* of the paper exit 5 when cutting the paper, there is a problem of the movable knife 22 curling and pushing the upstream end part of the cut-off portion 11*c* of the label paper 11 down. When the movable knife 22 returns to the standby position C, the curled part may also spring back with the returning force.

However, because the stage surface 40 that defines the bottom edge 5*a* of the paper exit 5 extends substantially horizontally slightly below the position of the cutting edge 22*a* of the movable knife 22 when at the cutting-completed position D, the movable knife 22 does not push the upstream end part of the cut-off portion 11*c* down when moving to the cutting-completed position D, and the upstream end part of the cut-off portion 11*c* is always above the bottom edge 5*a* of the paper exit 5. The upstream end part of the cut-off portion 11*c* therefore is not caused to curl, and when cutting is complete, the upstream end part of the cut-off portion 11*c* is therefore deposited substantially flat on the stage surface 40.

When the cut-off portion 11*c* is deposited on the stage surface 40, the cut-off portion 11*c* covers the top of the protrusion 47 projecting from the first side wall 42 and the protrusion 45 projecting from the center widthwise to the printer. As a result, the cut-off portion 11*c* is made unstable by the protrusion 47 and the protrusion 45 immediately after being deposited on the stage surface 40. If the cut-off portion 11*c* loses balance, it may drop down from the stage surface 40 along the sloped guide surface 41 and be discharged to the outside from the paper exit 5. At this time, if the first side wall 42 side of the cut-off portion 11*c* that is cut first drops to the sloped guide surface 41 first, the second side wall 43 side of the cut-off portion 11*c* will ride onto the top of the second side wall 43, and the cut-off portion 11*c* may be left on the stage surface 40 and block the paper exit 5. However, because the notched step 49 is formed on the second side wall 43, the cut-off portion 11*c* does not remain on the stage surface 40 and is discharged smoothly.

Because the contact pressure of this scissor type automatic cutter 20 between the cutting edge 21*a* of the fixed knife 21 and the cutting edge 22*a* of the movable knife 22 is applied on the support shaft 38 side that is the pivot axis of the cutting edge 22*a*, the pressure weakens gradually with distance from the support shaft 38 to the other side of the printer (the distal end side of the movable knife 22). In addition, adhesive between the web liner 11*a* and the continuous label 11*b* is squeezed out from the other edge 11*d* of the label paper 11 widthwise to the printer (see FIG. 3) when the paper is cut because the label paper 11 is squeezed between the fixed knife 21 and the movable knife 22 from the support shaft 38 side, and the adhesive may stick to the edge of the fixed knife 21 or the cutting edge 22*a* of the movable knife 22 at the distal end side of the movable knife 22, and may move gradually down due to gravity, for example, and accumulate on the stage surface 40. When adhesive sticks to the stage surface 40, the adhesive can get between the cutting edge 22*a* of the movable knife 22 and the cutting edge 21*a* of the fixed knife 21, interfere with cutting and cause cutting problems.

However, because a notched opening 44 is formed in the edge part of the stage surface 40 on the other side of the paper width (the part at the distal end side of the movable knife 22) in this embodiment of the invention, the adhesive drops from the notched opening 44 and is removed from the stage surface 40. Accumulation of adhesive on the stage surface 40 is thus reduced or avoided, and cutting problems caused by adhesive squeezed from the label paper 11 can be avoided.

Furthermore, because the downstream edge 44*a* of the notched opening 44 is positioned on the downstream side in the paper transportation direction from the movable knife 22, adhesive sticking to the downstream end of the movable knife 22 can also be removed from the notched opening 44 if it sticks to the stage surface 40.

Note that because the second side wall 43 can move widthwise to the printer sliding on the surface part of the stage surface part 40*a* on the downstream side in the paper transportation direction from the downstream edge in the paper discharge direction of the notched opening 44, the sloped guide surface 41, and the stepped surface, the second side wall 43 does not interfere with the notched opening 44 and will not block the notched opening 44. As a result, adhesive that moves from the end of the fixed knife 21 or the cutting edge 22*a* of the movable knife 22 will be removed regardless of where the second side wall 43 is positioned widthwise to the printer.

Other Embodiments

A notched opening 44 is formed in the upstream end of the stage surface 40 in the embodiment described above, but a narrow recessed step that is rectangular and long widthwise to the printer when seen in plan view can be formed instead of an opening, and adhesive that moves from the face of the fixed knife 21 or the cutting edge 22*a* of the movable knife 22 can be received into this recessed step.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cutter comprising:

a fixed knife;

a movable knife that moves relative to the fixed knife and cuts across a paper in a cutting direction when cutting the paper, wherein the movable knife is rendered to pivot at one end part thereof and cuts across the paper by moving from a standby position to a cutting-complete position; and a paper exit having opposing surfaces from which the paper is discharged in a discharge direction, wherein a cut-off portion of the paper contacts each of the opposing surfaces during cutting and discharge of the paper, wherein one of the opposing surfaces defines a substantially horizontal stage surface adjacent the fixed knife that extends along its cutting edge and is offset from the cutting edge so that the stage surface opposes and is adjacent to a cutting edge of the movable knife in the cutting-complete position so as to contact an upstream end-part of a cut-off portion of the paper after cutting with the movable knife, and wherein the stage surface comprises a notch formed at a position on the cutting edge side of the movable knife adjacent an end of the movable knife opposite the one end part at which the movable knife pivots, wherein the notch remains open and free from interference during cutting and discharge to allow an adhesive squeezed from the paper during cutting to flow away from the cutting edges of the fixed and movable knives thereby inhibiting interference between the knives from accumulation of the adhesive.

2. The cutter described in claim 1, wherein:

the notch is a narrow notched opening that is long in the cutting direction of the movable knife or the fixed knife.

3. The cutter described in claim 1, wherein:

the notch is a narrow notched step that is long in said cutting direction in plan view.

4. The cutter described in claim 1, wherein:

a downstream edge of the notch that is downstream in the paper discharge direction is positioned on a downstream side in the paper discharge direction from the movable knife.

5. The cutter described in claim 1, wherein one of the opposing surfaces of the paper exit defines a bottom side surface of the paper exit and the paper exit further comprises:

a sloped guide surface extending downward in the downstream direction of the paper discharge direction at the downstream edge of the bottom side surface in the paper discharge direction, and a first side wall that defines one side of the cutting direction of the paper that passes over the bottom side surface and the sloped guide surface and can move in the cutting direction relative to said bottom side surface and the sloped guide surface, and a second side wall that defines the other side of the cutting direction of the paper and can move in the cutting direction relative to a portion of the bottom side surface, wherein the second side wall is disposed further downstream than the downstream edge in the paper discharge direction of the notch and the sloped guide surface such that the notch remains open and accessible when the second side wall is moved to or adjacent the notch.

6. The printer of claim 1, wherein the stage surface extends substantially continuously along the fixed knife outside of the notch.

7. The printer of claim 1, wherein the notch is dimensioned so as to receive accumulation of the adhesive squeezed from the paper during cutting and adapted to facilitate removal of adhesive from the notch or the fixed knife through the notch.

8. A printer comprising:

a cutter that has a fixed knife and a movable knife that pivots on one end part thereof relative to the fixed knife and cuts across a paper in a cutting direction by moving from a standby position to a cutting-complete position;

a paper exit that has opposing surfaces from which the paper is discharged in a discharge direction, wherein a cut-off portion of the paper contacts each of the opposing surfaces during cutting and discharge of the paper, wherein one of the opposing surfaces defines a substantially horizontal stage surface adjacent the fixed knife that extends along its cutting edge and is offset from the cutting edge so that the stage surface opposes and is adjacent to a cutting edge of the movable knife in the cutting-complete position so as to contact an upstream end-part of a cut-off portion of the paper after cutting with the movable knife, and wherein the stage surface comprises a notch formed at a position on the cutting edge side of the movable knife adjacent an end of the movable knife opposite the one end part at which the movable knife pivots, wherein the notch remains open and free from interference during cutting and discharge to allow an adhesive squeezed from the paper during cutting to flow away from the cutting edges of the fixed and movable knives thereby inhibiting interference between the knives from accumulation of the adhesive; and a cover that opens and closes to a case;

the movable knife being disposed on the case side and the fixed knife being disposed on the cover side.

9. The printer described in claim 8, wherein:

the notch is a narrow notched opening that is long in the cutting direction of the movable knife or the fixed knife.

10. The printer described in claim 8 , wherein:

the notch is a narrow notched step that is long in said cutting direction in plan view.

11. The printer described in claim 8, wherein:

a downstream edge of the notch that is downstream in the paper discharge direction is positioned on a downstream side in the paper discharge direction from the movable knife.

12. The printer described in claim 8, wherein:

one of the surfaces defines a bottom side of the paper exit, a sloped guide surface extending downward in the downstream direction of the paper discharge direction at the downstream edge of the bottom side surface in the paper discharge direction, and the printer further comprises a first side wall that defines one side of the cutting direction of the paper that passes over the bottom side surface and the sloped guide surface and can move in the cutting direction relative to said bottom side surface and the sloped guide surface, and a second side wall that defines the other side of the cutting direction of the paper and can move in the cutting direction relative to a portion of the bottom side surface, wherein the second side wall is disposed further downstream than the downstream edge in the paper discharge direction of the notch and the sloped guide surface such that the notch remains open and accessible when the second side wall is moved to or adjacent the notch.

13. The printer of claim 12, wherein the second side wall is spaced downstream from the notch sufficiently to allow the notch to remain open and accessible.

14. The printer of claim 12, wherein the second side wall includes a stepped down portion of the second side wall adjacent the notch, when the second side wall is positioned at the notch, to allow the notch to remain open and accessible.

15. The printer of claim 8, wherein the notch remains accessible from outside the printer during cutting and printing so as to facilitate removal of adhesive from or adjacent the notch.

* * * * *